US008528729B2

(12) United States Patent
Juveland et al.

(10) Patent No.: US 8,528,729 B2
(45) Date of Patent: Sep. 10, 2013

(54) LIGHT-WEIGHT GOLF BAG CAPABLE OF BEING DISMANTLED

(76) Inventors: Lars E. Juveland, Los Alamos, NM (US); Lee G. Weinland, III, Los Alamos, NM (US)

( * ) Notice: Subject to any disclaimer, the term of this patent is extended or adjusted under 35 U.S.C. 154(b) by 547 days.

(21) Appl. No.: 12/725,830

(22) Filed: Mar. 17, 2010

(65) Prior Publication Data

US 2010/0258462 A1 Oct. 14, 2010

(51) Int. Cl.
*B65D 3/28* (2006.01)

(52) U.S. Cl.
USPC ..... 206/315.5; 206/315.1; 206/315.2; 206/315.3; 220/4.09; 220/666; 229/103

(58) Field of Classification Search
USPC ..... 206/315.1, 315.2, 315.3, 315.5; 229/5.5, 229/125.28, 4.5
See application file for complete search history.

(56) References Cited

U.S. PATENT DOCUMENTS 2,736,485 A * 2/1956 Rabby ..... 229/110
3,313,333 A * 4/1967 Lordi ..... 220/666
4,249,586 A 2/1981 Setani
4,951,816 A * 8/1990 Smith ..... 206/279
5,072,867 A 12/1991 Zingale
5,186,374 A 2/1993 Buxton
5,297,328 A 3/1994 Reimers et al.
5,636,739 A * 6/1997 Weder et al. ..... 206/423
5,720,429 A * 2/1998 Cordle ..... 229/120.18
5,755,376 A * 5/1998 Greer et al. ..... 229/107
6,279,740 B1 8/2001 Dorman
6,357,586 B2 3/2002 Pratt et al.
6,401,952 B1 * 6/2002 Ming ..... 220/4.09
6,629,601 B1 10/2003 Russell
7,984,842 B2 * 7/2011 Richie ..... 229/103

OTHER PUBLICATIONS

International Search Report for PCT/US2011/023286, International Searching Authority, Jun. 3, 2011, pp. 1-13.

* cited by examiner

*Primary Examiner* — Anthony Stashick
*Assistant Examiner* — Cynthia Collado
(74) *Attorney, Agent, or Firm* — Samuel M. Freund; Cochran Freund & Young LLC

(57) ABSTRACT

A light weight golf bag fabricated from a sheet of low-cost polymer film or sheet is described. Although the bag may weigh as little as one pound, it is strong and durable, and sufficiently sturdy to be freestanding, self-supporting, and to contain golf clubs. Embodiments of the golf bag may readily be assembled and disassembled.

4 Claims, 6 Drawing Sheets

LIGHT-WEIGHT GOLF BAG CAPABLE OF BEING DISMANTLED

FIELD OF THE INVENTION

The present invention relates generally to golf bags and, more particularly, to light-weight golf bag capable of being dismantled.

BACKGROUND OF THE INVENTION

Most golf bags are of sturdy construction since they provide many functions. Typically, golf bags have dividers to separate groups of clubs, and to increase the bag's stability. A complete set of 14 golf clubs for regulation play is heavy and bulky, and golf bags designed for travel must endure the rigors of rough handling and contact with other bags and other items in transit. Many bags have built in stands which may add to their weight, and most bags are adapted to fit on golf carts which requires robust construction to withstand the jostling associated with passing over uneven ground.

Retail stores and golf club manufactures often use golf bags for displaying sets of clubs, such as children's clubs or particular lines of putters, as examples, within particular stores and at conventions. The names, logos, graphics, or other advertising of the manufacturers and/or the displaying store may be printed on the bags or individually emblazoned with stick-on decals and the like to improve product or supplier awareness. When the promotion or sale is over, however, such bags, if permanently marked, must be stored until the next promotion, or disposed of. Smaller golf bags which may be dismantled for storage and shipping would clearly be advantageous.

Small golf bags are also desirable for holding a few clubs to be kept in the trunk of a car or in the corner of an office for a practice round, as a "Sunday" bag, or for display of collector clubs. A light-weight golf bag having smaller capacity would be useful for 9-hole courses where a full complement of clubs is not needed. For use as a Sunday bag, however, the golf bag should be relatively rigid so that it may be self-standing and/or leaned against a tree or other object.

Shipping of articles from manufacturers outside the United States is charged by volume. Therefore, a golf bag which is stackable and readily assembled after arrival at its destination should have significantly reduced cost of manufacture.

With airlines typically charging checked baggage fees, travel costs may be reduced by checking a full-sized golf bag containing all of the golf clubs to be shipped, and carrying on-board one or more smaller, empty, light-weight bag, perhaps disassembled.

SUMMARY OF THE INVENTION

Accordingly, it is an object of the present invention to provide a light-weight golf bag.

Another object of the invention is to provide a light-weight golf bag capable of being assembled and disassembled.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects, and in accordance with the purposes of the present invention, as embodied and broadly described herein, the golf bag, hereof, includes: an elongated rectangular plastic sheet having a first long side and an opposing second long side parallel thereto and coextensive therewith, a first short side and an opposing second short side; means for detachably securing the first long side to the second long side, such that a cylinder having an axis and a wall formed by the plastic sheet is generated when the first long side and the second long side are brought into overlapping communication, the cylinder further having a top opening defined by the first short side, and a circular bottom opening defined by the second short side, wherein the circular bottom opening has an axis collinear with the axis of the cylinder; a circular sheet adapted to fit into the circular bottom opening; and means for detachably securing the circular sheet to the wall of the cylinder at a chosen location interior thereto.

In another aspect of the invention, and in accordance with its objects and purposes, the golf bag, hereof, includes: an elongated rectangular plastic sheet having a first long side and an opposing second long side parallel thereto and coextensive therewith, a first short side and an opposing second short side; at least one locking tab formed along the first long side and extending perpendicularly thereto, and at least one slot in the plastic sheet in the region of the second long side adapted for disengageably receiving the at least one locking tab for securing the first long side to the second long side in an overlapping manner such that a cylinder having a wall formed by the plastic sheet is generated, and having a top opening formed by the first short side, and a circular bottom opening formed by the second short side; a circular sheet adapted to fit into the circular bottom opening, the circular sheet having at least one locking tab for detachably securing the sheet to the wall of the cylinder at a chosen location interior thereto.

Benefits and advantages of the present invention include, but are not limited to, providing a strong, durable, light-weight golf bag capable of being assembled and disassembled. The bag may be formed from a single sheet of inexpensive plastic sheet by single-pass die-cutting using a high speed web press, the press being capable of simultaneously printing or embossing logos and other information on the bag. Because of the inherent strength of plastic sheet when formed into a circular tube shape, further bracing or support may not be required. Assembly and disassembly may be accomplished in a few minutes.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION OF THE INVENTION

Briefly, the present invention includes a light weight golf bag fabricated from a sheet of low-cost polymer film or sheet, polyethylene, as an example, by die-cutting in one pass through a high speed web press or using laser cutter. Although the bag may weigh as little as one pound, it is strong and durable, and sufficiently sturdy to be freestanding, self-supporting, and to contain golf clubs. The inherent physical characteristics of polymer sheeting when formed into a tube, provides such characteristics with only limited additional bracing or support. Larger versions of the golf bag may hold the regulation 14 clubs or even greater numbers of clubs.

Smaller embodiments of the present golf bag may find use as a storage bag containing a few clubs to be kept in the trunk of a car or in the corner of an office available for a practice round or for display of collector's clubs. Retail stores may use the golf bag to display individual clubs, children's club sets, or groupings of clubs, for example, "Ping putters," for sale. The club manufacturer or store name, logo or graphics, or other sponsorship information may be mass printed on the bag simultaneously with cutting process, or on its components, making them suitable for specialty advertising and marketing, or individually emblazoned with computer stick-on decals for enhanced product awareness. Polymeric sheets are available in a variety of colors and textures, permitting an array of individual color schemes to be adapted to many uses, and eliminating need and cost of additional coverings or cloth shells as would be required for existing golf bags for similar usage. Clear sheeting would allow the clubs to be viewed.

The golf bag may be made of biodegradable and disposable polymer sheets that are ecologically friendly and recyclable, thereby making the bag a "green" product. Assembly, and disassembly for certain embodiments of the invention, may be accomplished by an end user in a few minutes.

Figure 1:
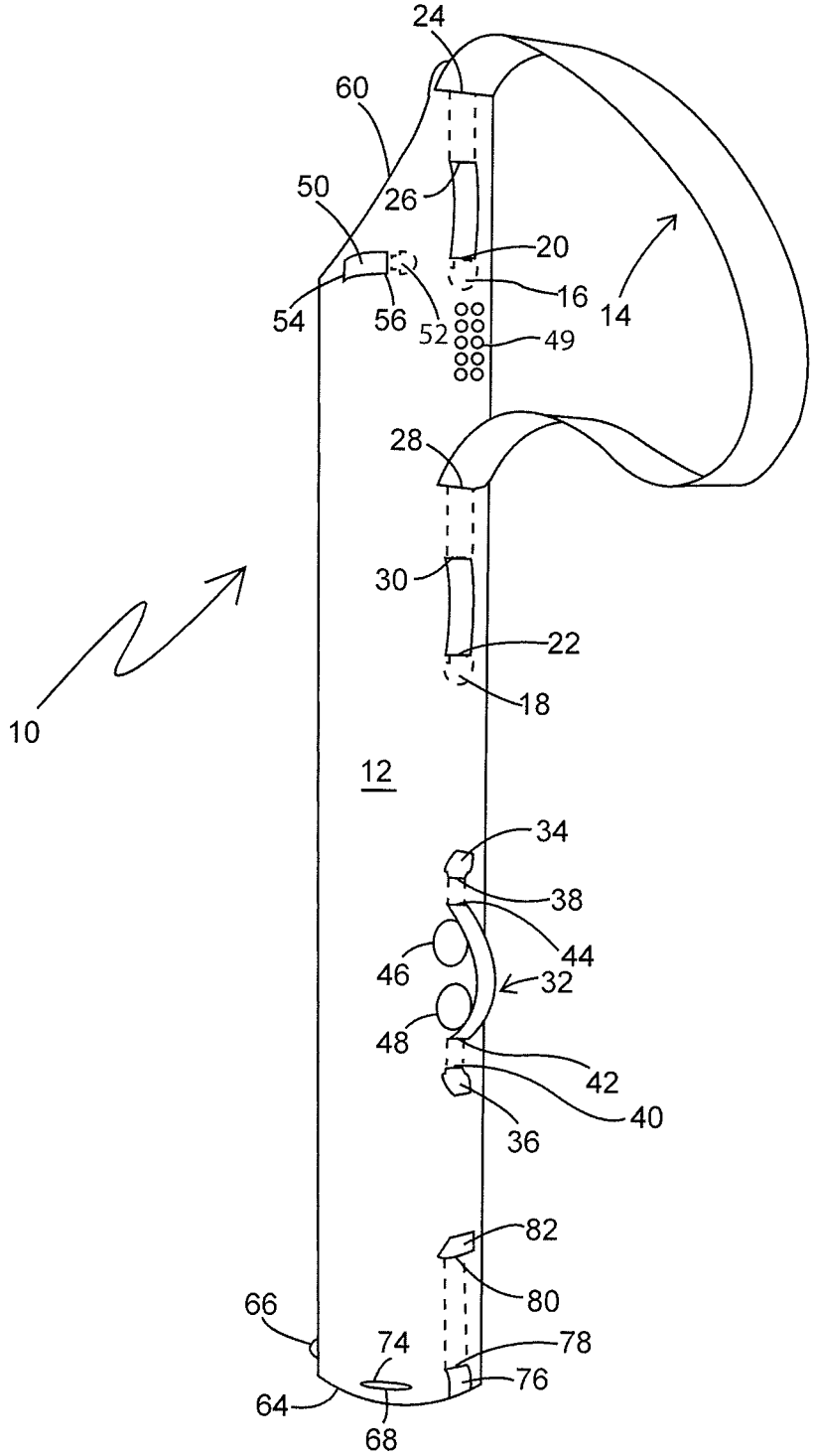
FIG. 1 is a schematic representation of a perspective rear and side view of an embodiment of the assembled golf bag of the present invention, illustrating the attachment of a shoulder strap for carrying the bag, and the attachment of a golf ball holder strap for securing golf balls on the outside of the bag.

Reference will now be made in detail to the present embodiments of the invention, examples of which are illustrated in the accompanying drawings. Identical reference characters are used to represent similar or identical structure. Turning now to the FIGURES, FIG. 1 is a schematic representation of a perspective rear and side view of an embodiment of golf bag 10 of the present invention. Cylindrical tube or cylinder, 12, may be formed from a single plastic sheet, as will be described hereinbelow. Shoulder strap, 14, effective for carrying bag 10, shown attached to tube 12, by flared locking tabs, 16, and 18, disposed at opposite ends of shoulder strap 14, and inserted through slots, 20, and 22, in tube 12, respectively, after being threaded through slots 24, and 26, and 28, and 30, respectively. Golf ball holder strap, 32, is shown attached to tube 12 by flared locking tabs, 34, and 36, disposed at opposite ends of ball holder strap 32, and inserted through slots, 38, and 40, respectively, after being threaded through slots, 40, and 44, respectively, in tube 12. Golf ball retaining holes, 46, and 48, are formed in the wall of tube 12 and have slightly smaller diameters than the diameter of a golf ball. Such holes are shown as being disposed directly under fastened ball holder strap 32 adapted for holding inserted golf balls in place. Additional ball holders, not shown in FIG. 1, may be added. Golf tee holders may be provided by holes, 49, formed in the wall of tube 12 adapted for receiving and securing tees. At least one golf club separator member, 50, not shown in FIG. 1, effective for separating the golf clubs and for providing additional strength to tube 12, is fastened on one side to tube 12 by locking tab, 52, inserted in turn through slots, 54, and 56, in tube 12, with an opposing locking tab, 58, (not shown in FIG. 1) disposed on the other side of tube 12, near open upper end, 60, thereof. Circular plate, 62, not shown in FIG. 1, is fastened to tube 12 in the vicinity of lower or bottom end, 64, thereof, by locking tabs, 66, and, 68, with opposing locking tabs, 70, and 72, respectively, similarly employed but not shown in FIG. 1, tab 68 shown as being inserted through slot, 74, in tube 12. Tube 12 locking and reinforcing member, 76, is shown inserted into slot, 78, and emerging from slot, 80, in tube 12 locking tab, 82, as will be described in greater detail hereinbelow.

Figure 2:
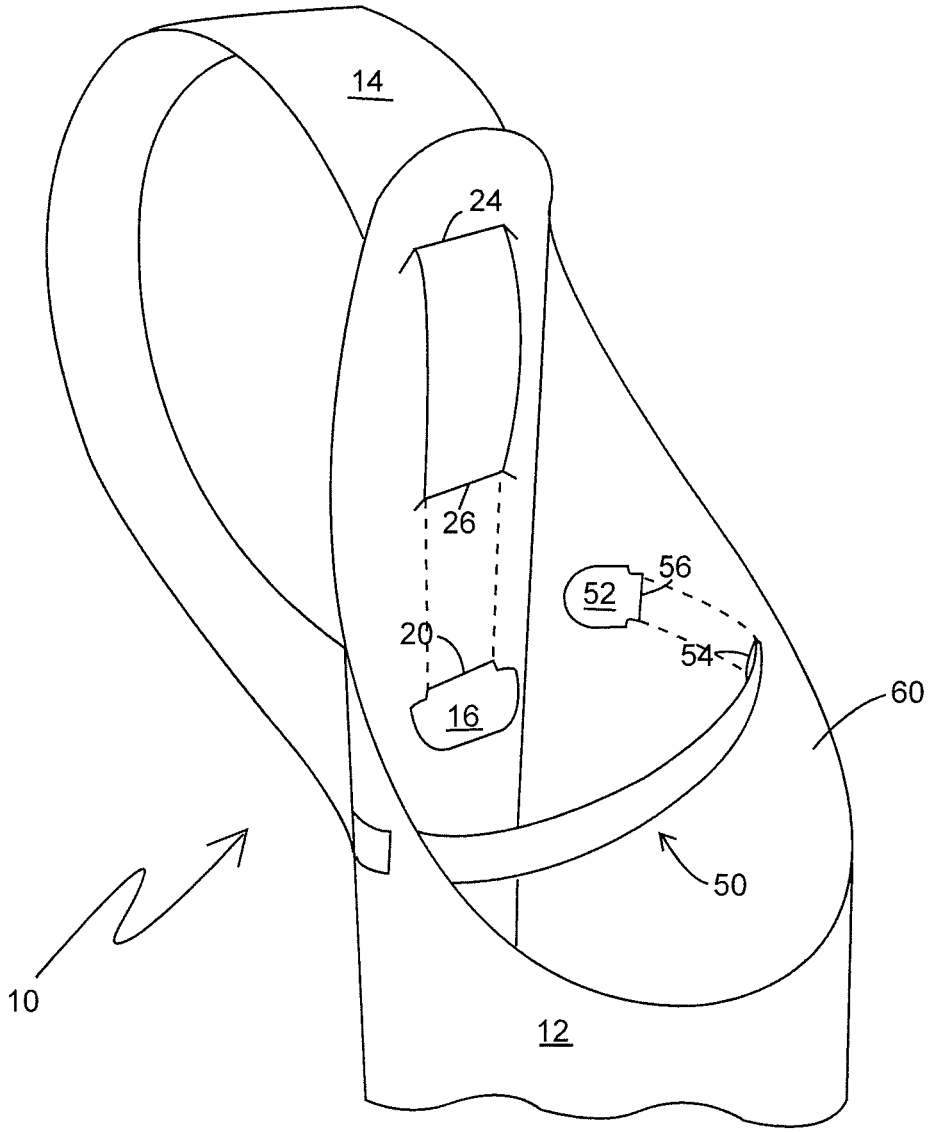
FIG. 2 is schematic representation of a perspective view of the top of the golf bag shown in FIG. 1 hereof, illustrating the circular cross section of the golf bag and the location of the club divider strap.

FIG. 2 shows a perspective top view of golf bag 10 shown in FIG. 1 hereof, illustrating the circular cross section of the upper or top end 60 of tube 12 and the location of club divider or separator member 48. Upper end 60 is shown having a downward slope toward the front of bag 12 in order to permit easier insertion and removal of golf clubs.

Figure 3:
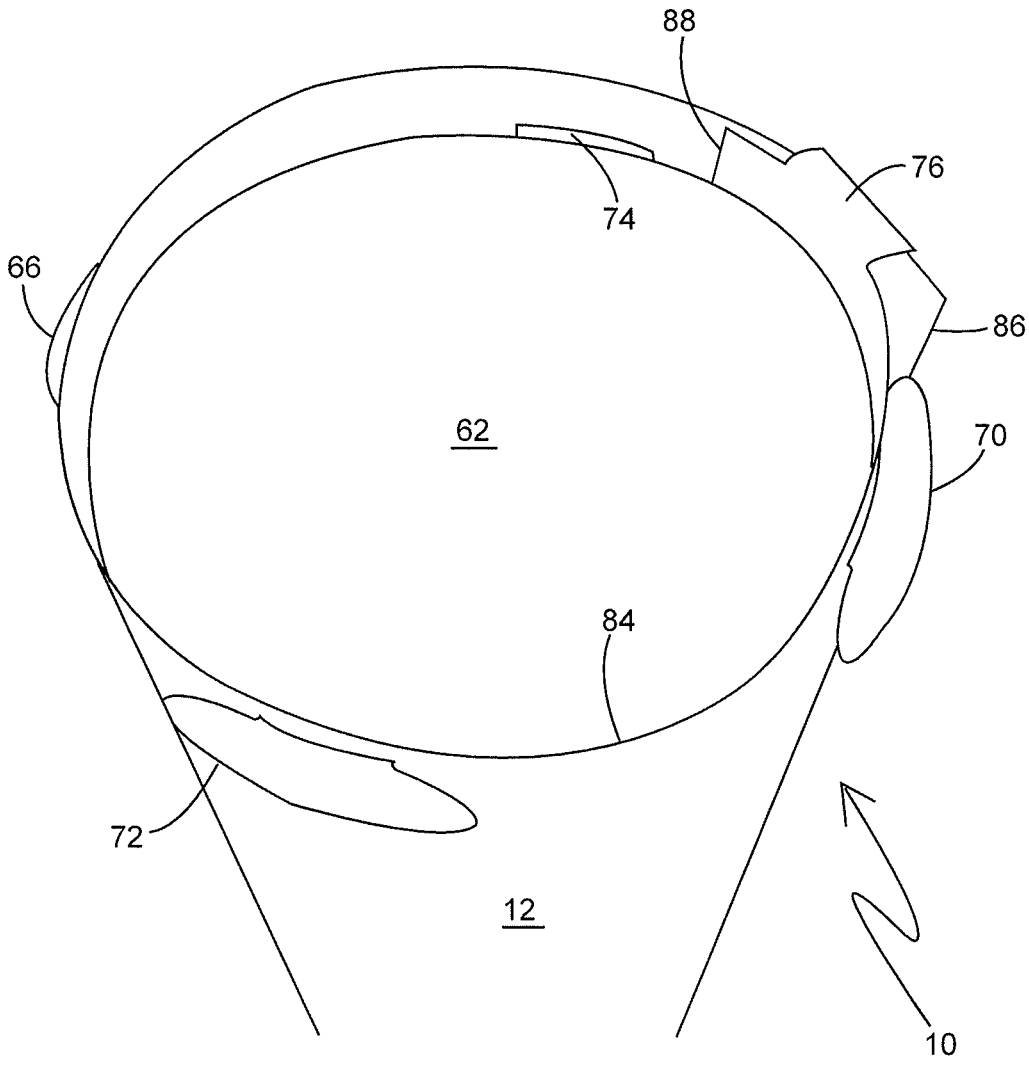
FIG. 3 is a schematic representation of a perspective view of the lower end of the golf bag shown in FIG. 1 hereof, illustrating locking tabs in the circular plate inserted through slots in the cylindrical wall of the golf bag.

FIG. 3 is a schematic representation of a perspective view of the lower end of the golf bag 12 shown in FIG. 1 hereof, illustrating locking tabs 66, 70 and 72 formed on circular plate 62 (FIG. 4B) inserted through slots in the cylindrical wall of the golf bag. Shown also in FIG. 3 are overlapping vertical ends, 86, and, 88 of wall 84 of tube 12, when assembled, in part held together and stabilized by tube locking and reinforcing member 76.

Figure 4A:
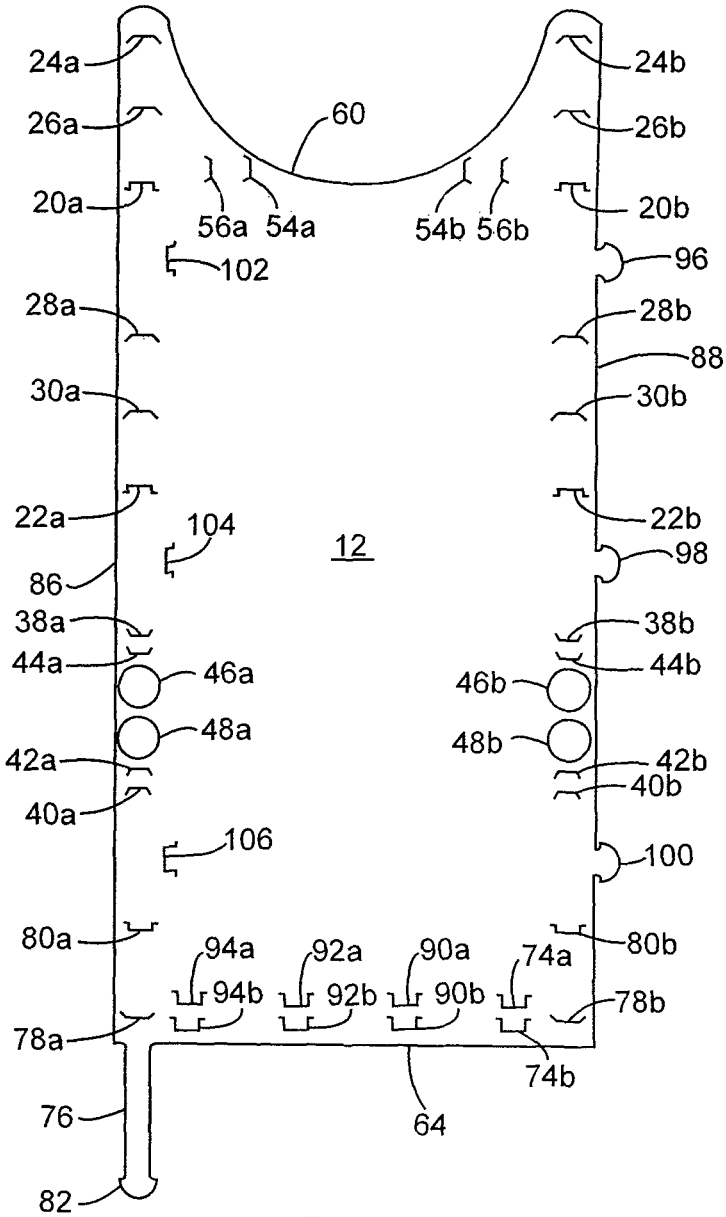
FIG. 4A is a schematic representation of a top view of the unfolded flat plastic sheet which when assembled generates the tubular portion of the golf bag shown in FIG. 1, hereof, illustrating the locking tabs and slots thereof for assembling the tube.
Figure 4B:
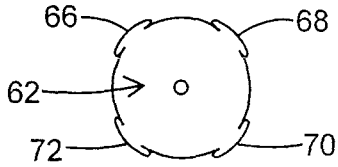
FIG. 4B is a schematic representation of a top view of the circular plate shown in FIG. 3, hereof, at least one of which is inserted into the bottom tubular portion of FIG. 1, hereof.

FIG. 4A is a schematic representation of a top view of the unfolded flat plastic sheet which when assembled generates tubular portion 12 of golf bag 10, not including shoulder strap 14, golf ball holder strap 32, and golf club partition member 50. Locking tabs, 96, 98, and 100, on vertical side 88 insert into slots 102, 104, and 106 in the sheet, respectively, permitting sides 86 and 88 to be overlapped and reversibly secured. After installation of at least one circular plate 62 (FIG. 4B) into the circular opening formed at lower end 64, of tube 12, and inserting locking tabs 66, 68, 70, and 72 into slots 74*a*, 90*a*, 92*a*, and 94*a*, and/or 74*b*, 90*b*, 92*b*, and 94*b*, respectively, depending on whether more than one plate is utilized, locking and reinforcing member 76 may be threaded through overlapping slots 78*a* and 78*b*, and inserted through overlapping slots 80*a* and 80*b*, to more securely hold tube 12 together. The selection of which set of slots is to be employed for securing a circular plate, permits adjustment the length of the interior of the golf bag so that different sized golf clubs may be accommodated. Additional sets of slots 74, 90, 92 and 94, may be added in order to carry short clubs without changing the overall length of golf bag 10. Multiple circular plates 62 may be employed, for increasing the strength of golf bag 10 and for contributing to the free-standing capability thereof. The at least one circular plate 62 may be fabricated from the same plastic material as tube 12, or other suitable flexible materials. Top portion 60 is shown having a concave shape in order to provide the downward sloping opening shown in FIG. 2, hereof.

Assembled golf bag 10 hereof may readily be disassembled, if desired, since the fasteners and tabs are reversibly connected and provide detachable or disengageable attachment or securement of the various parts and portions hereof.

Slots 20, 24, 26, 28, 30, 38, 40, 42, 44, 78, and 80, in the plastic sheet further marked with an "a" or a "b", overlap with their corresponding slots when tube 12 is formed from the sheet, and locking tabs inserted therethrough are passed through both slots. The locking tabs securely lock in place once inserted through the slots.

Figure 4C:
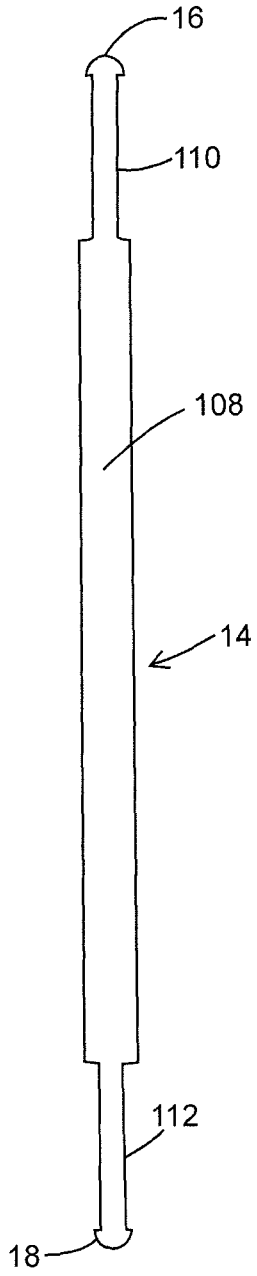
FIG. 4C is a schematic representation of the shoulder strap illustrated in FIG. 1, hereof.
Figure 4D:
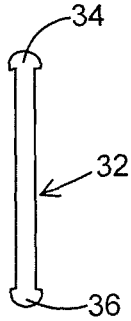
FIG. 4D is a schematic representation of the ball holder strap shown in FIG. 1 hereof.
Figure 4E:
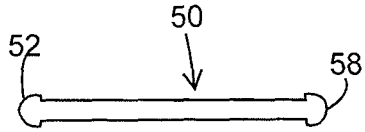
FIG. 4E is a schematic representation of the club divider strap shown in FIG. 2, hereof.

FIGS. 4C and 4D show shoulder strap 14 and ball holder strap 32, both illustrated in FIG. 1, hereof, and FIG. 4E shows club divider strap 50 illustrated in FIG. 2, hereof. Carrying strap 14 is shown having a wide portion, 108, suitable for placing over a user's shoulder, while narrower portions, 110, and 120 permit the strap to be threaded through the slots in tube 12. Shoulder strap 14, ball holder strap 32 and divider strap 50 may be fabricated from the same plastic material as that for tube 12 and bottom member 62, or other suitable flexible materials.

Figure 4F:
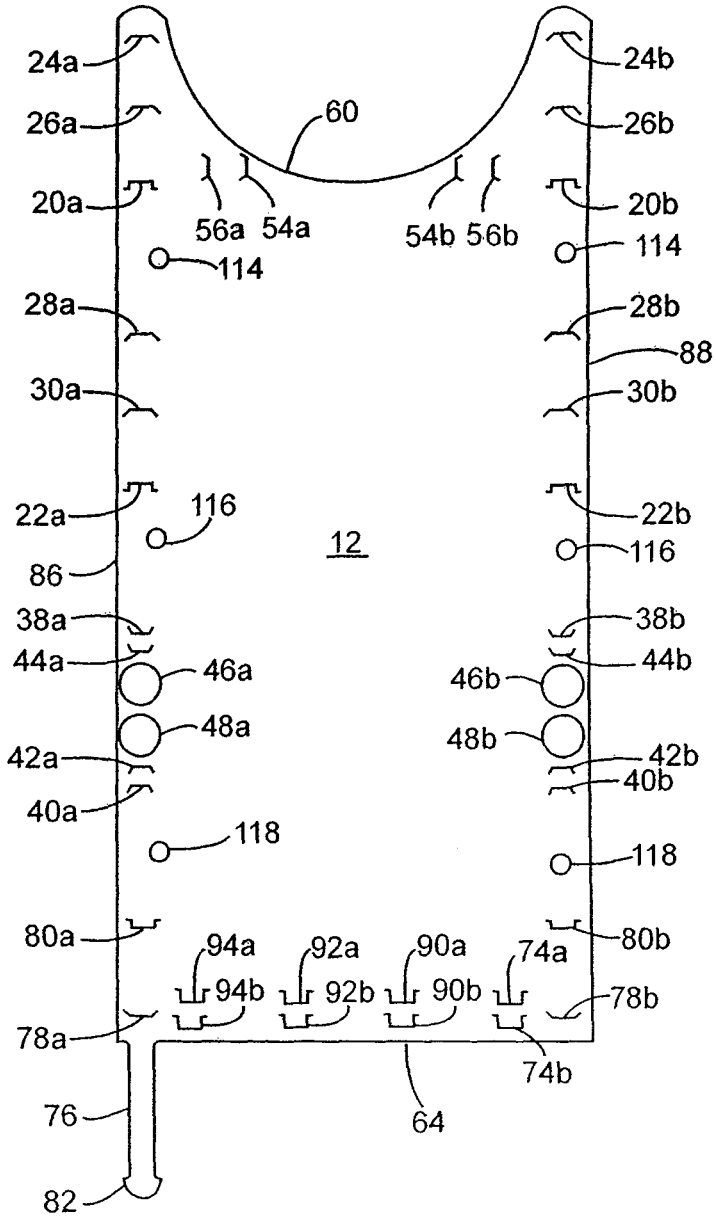
FIG. 4F is a schematic representation of another embodiment of the unfolded flat plastic sheet having snap means for disengagingly securing the golf bag in the tubular configuration illustrated in FIG. 1.

FIG. 4F shows another embodiment of the unfolded flat plastic sheet adapted for reversibly assembling tubular portion 12 of golf bag 10. Snaps, 114, 116, and 118, provide the same functionality as locking tabs 96, 98, and 100 and slots 102, 104 and 106 illustrated in FIG. 4A hereof. Other fastening means such as grommet snaps, metal buttons, and VELCRO® hook and loop fasteners, as examples, may be readily implemented.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A golf bag comprising:

an elongated rectangular plastic sheet having a first long side and an opposing second long side parallel thereto and coextensive therewith, a first short side and an opposing second short side;

means for disengageably securing the first long side to the second long side in an overlapping manner, such that a cylinder having an axis and a wall formed by the plastic sheet is generated, said cylinder further having a top opening defined by the first short side, and a circular bottom opening defined by the second short side, wherein the circular bottom opening has an axis collinear with the axis of said cylinder, and wherein the wall of said cylinder has at least one hole therein having a diameter smaller than the diameter of a golf ball adapted for receiving and holding a golf ball;

a strap for securing a golf ball in the at least one hole;

a circular sheet adapted to fit into the circular opening formed by the second short side, thereby closing the circular opening; and means for reversibly attaching said circular sheet to the wall of said cylinder at a chosen location interior thereto.

2. A golf bag comprising:

an elongated rectangular plastic sheet having a first long side and an opposing second long side parallel thereto, a first short side and an opposing second short side;

at least one locking tab formed along the first long side and extending perpendicularly thereto, and at least one slot in said plastic sheet in the region of the second long side adapted for reversibly receiving the at least one locking tab for disengageably securing the first long side to the second long side in an overlapping manner such that a cylinder having a wall formed by said plastic sheet is generated, and having a top opening formed by the first short side, and a circular bottom opening formed by the second short side, wherein the wall of said cylinder has at least one hole therein having a diameter smaller than the diameter of a golf ball adapted for holding a golf ball;

a strap for securing a golf ball in the at least one hole; and a circular sheet adapted to fit into the circular opening formed by the second short side, said circular sheet having at least one locking tab for detachably attaching said sheet to the wall of said cylinder at a chosen location interior thereto.

3. A golf bag comprising:

an elongated rectangular plastic sheet having a first long side and an opposing second long side parallel thereto and coextensive therewith, a first short side and an opposing second short side;

means for disengageably securing the first long side to the second long side in an overlapping manner, such that a cylinder having an axis and a wall formed by the plastic sheet is generated, said cylinder further having a top opening defined by the first short side, and a circular bottom opening defined by the second short side, wherein the circular bottom opening has an axis collinear with the axis of said cylinder, and wherein the wall has at least one hole therein having a diameter smaller than the diameter of a golf tee adapted for receiving and holding a golf tee;

a circular sheet adapted to fit into the circular opening formed by the second short side, thereby closing the circular opening; and means for reversibly attaching said circular sheet to the wall of said cylinder at a chosen location interior thereto.

4. A golf bag comprising:

an elongated rectangular plastic sheet having a first long side and an opposing second long side parallel thereto, a first short side and an opposing second short side;

at least one locking tab formed along the first long side and extending perpendicularly thereto, and at least one slot in said plastic sheet in the region of the second long side adapted for reversibly receiving the at least one locking tab for disengageably securing the first long side to the second long side in an overlapping manner such that a cylinder having a wall formed by said plastic sheet is generated, and having a top opening formed by the first short side, and a circular bottom opening formed by the second short side, wherein the wall of said cylinder has at least one hole therein having a diameter smaller than the diameter of a golf tee adapted for receiving and holding a golf tee; and a circular sheet adapted to fit into the circular opening formed by the second short side, said circular sheet having at least one locking tab for detachably attaching said sheet to the wall of said cylinder at a chosen location interior thereto.

* * * * *